United States Patent [19]

Herman et al.

[11] 4,244,178

[45] Jan. 13, 1981

[54] POROUS LAMINATED COMBUSTOR STRUCTURE

[75] Inventors: Avrum S. Herman; Samuel B. Reider, both of Indianapolis, Ind.

[73] Assignee: General Motors Corporation, Detroit, Mich.

[21] Appl. No.: 887,879

[22] Filed: Mar. 20, 1978

[51] Int. Cl.[2] ..... F02C 3/00

[52] U.S. Cl. ..... 60/754

[58] Field of Search ..... 60/39.65, 39.66, 39.69; 431/351-353

[56] References Cited

U.S. PATENT DOCUMENTS

| | | | |
|---|---|---|---|
| 3,064,424 | 11/1962 | Tomlinson | 60/39.65 |
| 3,064,425 | 11/1962 | Hayes | 60/39.65 |
| 3,075,352 | 1/1963 | Shutts | 60/39.65 |
| 3,349,558 | 10/1967 | Smith | 60/39.69 |
| 3,557,553 | 1/1971 | Schmitz | 60/39.65 |
| 3,623,711 | 11/1971 | Thorstenson | 60/39.66 |
| 4,158,949 | 6/1979 | Reider | 60/39.65 |

*Primary Examiner*—Robert E. Garrett
*Attorney, Agent, or Firm*—J. C. Evans

[57] ABSTRACT

A combustor assembly for a gas turbine engine includes a tubular, multi-layered porous metal wall with pores and cavities for distribution of compressor discharge air into a combustion chamber and wherein a rigid combustor support ring connects one end of the porous wall to fixed support components of the gas turbine engine; the combustor assembly further including a porous metal transition member for joining the tubular porous metal wall to a downstream nozzle plate; the transition member including free formed side walls and top and bottom walls without substantial reduction in permeability due to forming and each of the transition walls further including a sharp radius bend at the side edge thereof defining a compressed porous metal section for connection to an adjacent sharp radius bend by means of a longitudinal seam weld along the length thereof to maximize the flow of secondary cooling air into the hot combustion gases passing from the outlet of the combustion chamber of the apparatus.

3 Claims, 6 Drawing Figures

POROUS LAMINATED COMBUSTOR STRUCTURE

The invention described herein was made in the course of work under a contract or subcontract thereunder with the Department of Defense.

This invention relates to gas turbine engine combustor apparatus and more particularly to such apparatus including wall components constructed of porous laminated metal to diffuse flow of compressor discharge air from exteriorly of the combustion apparatus into an internal combustion chamber therein during gas turbine engine operation.

Canister type combustion apparatus and flame tube constructions typically include a plurality of axially directed sleeve segments connected together by offset air distribution systems to provide wall cooling of the linear segments of a combustor apparatus to prevent excessive flame erosion of the inside surface of combustor walls. Examples of such systems are set forth in U.S. Pat. Nos. 3,064,424, issued 20, 1962, to Tomlinson; 3,064,425, issued Nov. 20, 1962, to C. F. Hayes; and 3,075,352 issued Jan. 29, 1963, to L. W. Shutts.

While the aforesaid canister type gas turbine engine combustors are suitable for their intended purpose, it is desirable to minimize flow of coolant air required to cool the inner wall of the combustion apparatus against flame erosion. Various proposals have been suggested to make the wall of the combustion apparatus of porous material to cool the internal wall combustion apparatus. One such arrangement is set forth in U.S. Pat. No. 3,557,553, issued Jan. 26, 1971, to Schmitz wherein porous metal fiber is compressed to provide a controlled amount of inlet coolant flow through pores in a mixing skirt and thence into a combustion chamber so as to obtain transpiration cooling of the interior wall of the combustion chamber. Another proposal for providing for a plurality of perforations to produce transpiration cooling effects on the interior wall of a combustion chamber is set forth in U.S. Pat. No. 3,623,711, issued Nov. 30, 1971, to Thorstenson. In both of these arrangements the upstream end of the combustion liner is imperforate to define structural support for the liner apparatus within a gas turbine engine.

An object of the present invention is to provide an improved combustion apparatus of the cannister type including a tubular porous metal liner with perforations therethrough and cavities between layers of porous metal in the combustion apparatus liner and wherein a transition member at the outlet of the canister type combustor includes porous laminated walls with small corner radii joined by longitudinal seam welds at the coolest regions of operation of the transition member and with the small corner radii and weld locations combined to minimize the blockage of air flow into hot gases flowing from the combustion apparatus to maximize cooling of the inner wall of the transition member.

Still another object of the present invention is to provide an improved gas turbine combustor assembly having a porous metal liner from the inlet to the outlet thereof and wherein a diffusion dam is located on a porous laminated sleeve of the combustion apparatus and connected thereto by intermittent tack welds that block a minimum of inlet pores across the porous metal region exposed to the annular combustion air passage of a gas turbine engine and to permit air to enter the porous metal region outside the support area and diffuse under the diffusion dam and to exit through the inside surface of the porous metal region at a point directly below the dam so as to cool the full extent of the inner surface of the combustion liner.

Yet another object of the present invention is to provide an improved canister type combustor formed with a porous metal sleeve continuously perforated between the inlet and outlet of the combustion apparatus and including a porous metal transition member including side walls and top and bottom walls having small corner radii edges joined together by a seam weld at the coolest region of transition member operation and wherein the pores through the small corner radii are compressed and further closed by the longitudinal seam weld to form a solid metal connection between the side walls and top and bottom walls of the transition member that minimizes blockage of coolant flow into the transition member for maximum cooling of the inner wall of the transition member.

Further objects and advantages of the present invention will be apparent from the following description, reference being had to the accompanying drawings wherein a preferred embodiment of the present invention is clearly shown.

Figure 1:
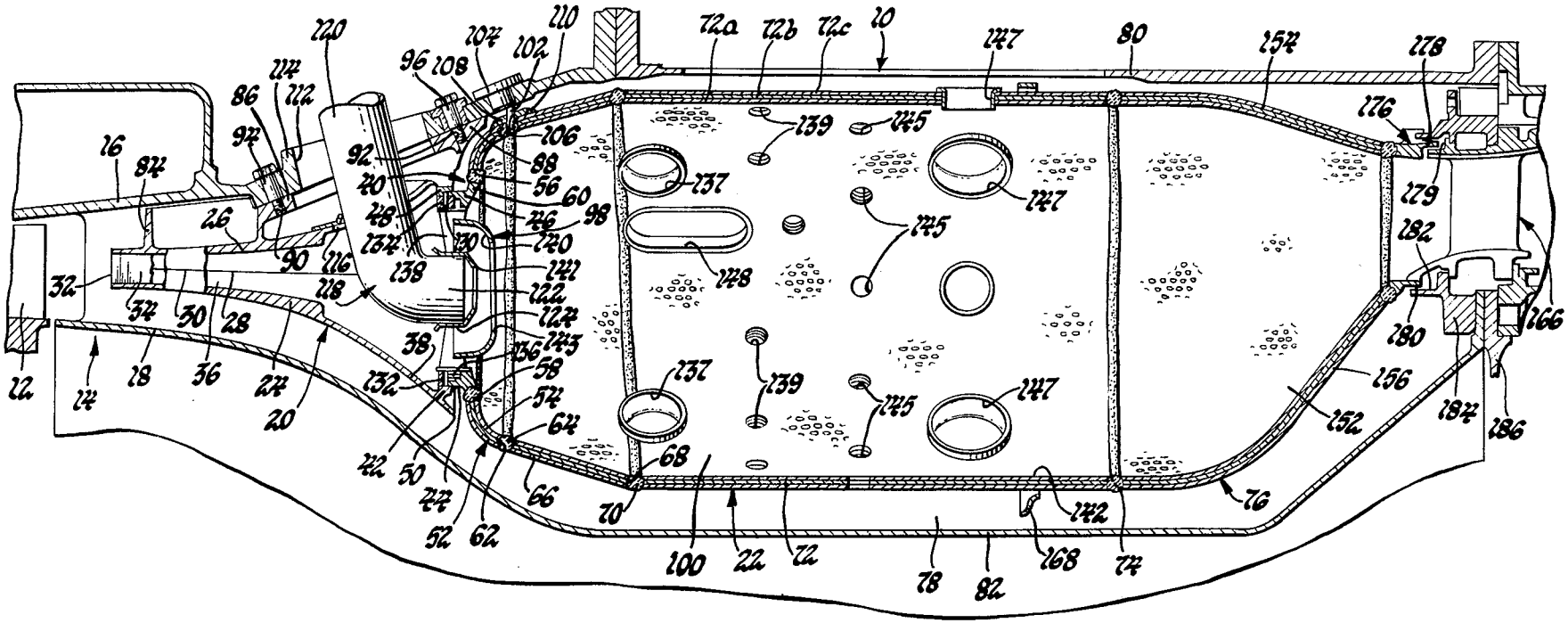
FIG. 1 is a longitudinal sectional view of a combustor apparatus in accordance with the present invention.
Figure 2:
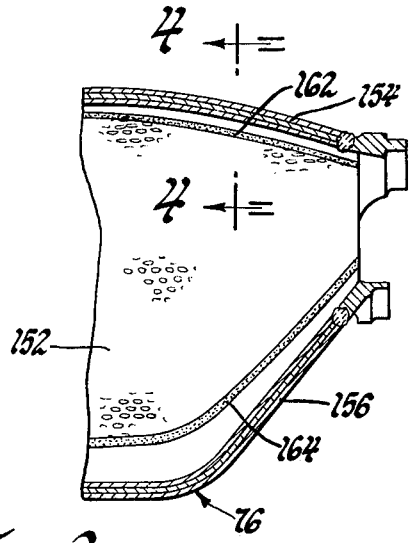
FIG. 2 is a fragmentary enlarged sectional view of the outlet in FIG. 1.
Figure 4:
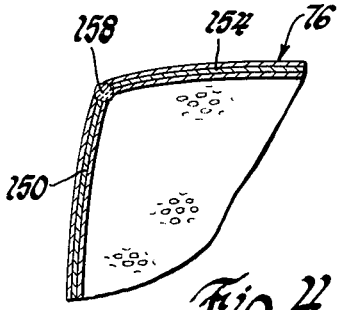
FIG. 4 is a fragmentary, enlarged sectional view along line 4—4 of FIG. 2.
Figure 3:
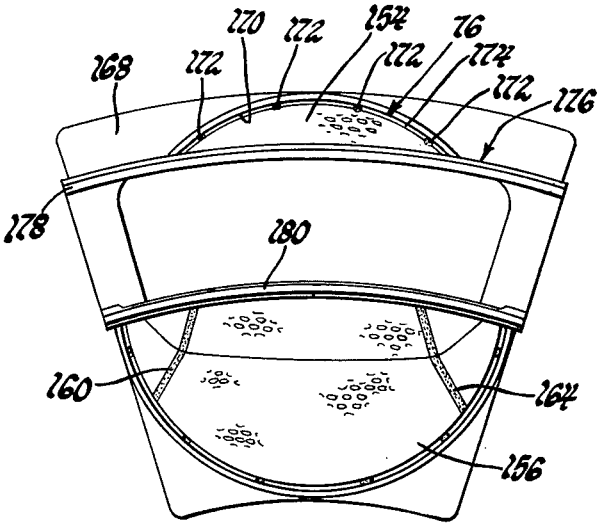
FIG. 3 is an end elevational view of a transition member of the present invention.
Figure 4A:
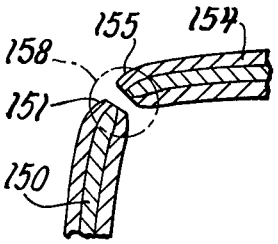
Figure 5:
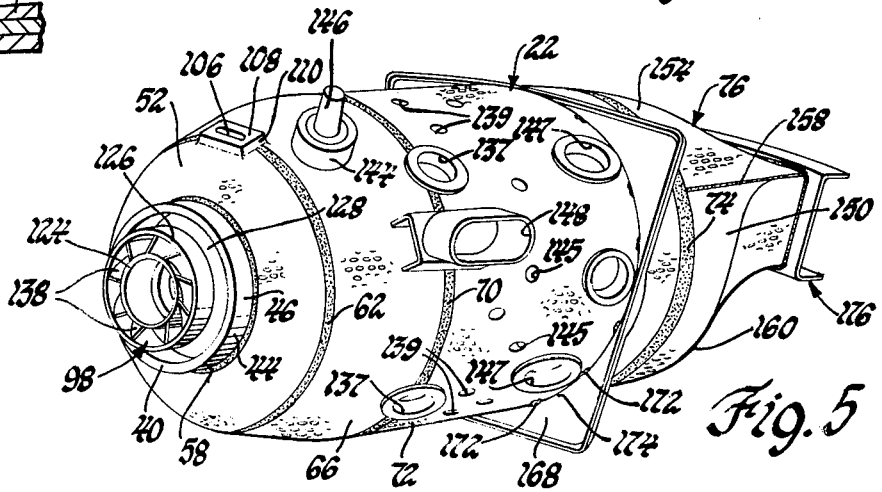

FIG. 4*a* is an enlarged view of region 4*a* in FIG. 4 prior to welding; and FIG. 5 is a view in perspective of the combustor apparatus in FIG. 1.

Referring now to the drawings, FIG. 1 shows a portion of a gas turbine engine 10 having a compressor 12 of the axial flow type in communication with a discharge duct 14 defined by a first radially outer annular engine wall 16 and a second radially inwardly located annular engine wall 18.

An inlet diffuser member 20 is located downstream of the discharge duct 14 to distribute compressed air from the compressor 12 to a canister type combustor assembly 22 constructed in accordance with the present invention.

More particularly, in the illustrated arrangement, the inlet diffuser member 20 includes a contoured lower plate 24 and a contoured upper plate 26 joined at their side edges by longitudinal seam welds 28, 30, respectively.

The plates 24, 26 together define a low profile inlet opening 32 located approximately at the mid-point of the duct 14. A flow divider plate 34 is located between the inlet ends of the plates 24, 26 to uniformly distribute compressed air flow into a radially divergent flow passage 36 formed between the lower and upper plates 24, 26 respectively which are contoured to define a generally circular outlet 38 at the inlet end 40 of the combustor assembly 22.

The lower plate 24 includes a downstream shoulder 42 that is supportingly received by the outer annular surface 44 of a rigid support ring 46. A support shoulder 48 on the upstream end of the upper plate 26 likewise is in engagement with the ring 46 at the outer surface 44 thereof to center an upstream extending annular lip 50 at the outlet of the inlet diffuser member 20 and to locate it in a radially spaced relationship with the ring 46 to direct coolant flow against the upstream end of a dome 52 of the combustor assembly 22.

The dome 52, more particularly, is made up of a first contoured ring 54 of porous laminated material that includes a radially inwardly located edge portion 56 thereon secured by an annular weld 58 to a radially outwardly directed flange 60 on the ring 46. Downstream edge 62 of ring 54 is connected by an annular weld 64 to a radially outwardly convergent contoured ring portion 66 of dome 52 also of porous laminated material. The contoured ring 66 has its downstream edge 68 connected by an annular weld 70 to a porous laminated sleeve 72 which is connected by means of an annular weld 74 to a flow transition member 76 of the combustor assembly 22.

Combustor assembly 22 and like canister combustor assemblies are located at circumferentially spaced points within an annular exhaust duct 78 formed between an outer engine case 80 and an inner engine wall 82. The inlet diffuser member 20 includes a divider 84 with a pair of spaced lands 86, 88 thereon with tapped holes 90, 92 formed therein to receive screws 94, 96 directed through the engine wall 16 to fixedly secure the inlet diffuser member 20 in place. Shoulders 42, 48 thereby are positioned axially of the ring 46.

Ring 46 also forms a housing for an air blast fuel atomizer assembly 98 that directs air and fuel into a combustion chamber 100 within the porous laminated sleeve 72. Axial location of the combustor assembly 22 is established by means of a pin 102 held by a bracket 104 within the wall 16. The pin 102 is located in interlocked relationship with a slot 106 of predetermined arcuate extent within an embossment 108 secured to the combustor assembly 22 by a weld 110 as best shown in FIG. 1.

In the illustrated arrangement, the wall 16 includes an access opening 112 and a mounting pad 114 that is in alignment with an opening 116 in the upper plate 26 of the inlet diffuser member 20 to provide access for fuel nozzle 118 of assembly 98. Nozzle 118 includes a generally radially outwardly directed stem portion 120 thereon and a nose portion 122 that is supported by an inner ring 124 of the assembly 98.

The assembly 98 further includes an outer annular shroud 126 thereon with a radial flange 128 supported by an undercut surface 130 on the inner periphery of ring 46.

The shroud ring 126 is fixedly secured with respect to the single structural support ring 46 by a locater ring 132 that is circumferentially fixed with respect to the support ring 46 by means of a pin 134. A pin 136 connects the locater ring 132 and the shroud ring 126 as best seen in FIG. 1.

The aforesaid support configuration defines a floating support for the assembly 98 to center to nozzle 118 and a plurality of inclined vanes 138 directed radially between the inner ring 124 and the shroud ring 126. The vanes 138 are angled to the longitudinal axis of the combustor 10 to produce a swirling action in air flow from the passage 36 into the combustion chamber 100. An intermediate annular guide ring 140 directs the swirled air radially inwardly for mixing with fuel from an outlet orifice in the nozzle 118 to thoroughly mix air/fuel to improve combustion within the chamber 100 during gas turbine engine operation. Lips 141 and 143 are formed inboard of rings 124, 140, respectively, to atomize fuel spray that mixes with air blast from the vanes 138.

The assembly 98 is thereby replaceable as a unit and includes a fuel supply to an air blast fuel injection system for the combustor assembly. A single support member in the form of ring 46 serves as a support for both the front end of a combustion liner and as a support for the swirler. Moreover, the floating swirler construction allows the vanes 138 to remain concentric with a fuel nozzle while the fuel nozzle and combustion liner are independently supported by the specially configured inlet diffuser member 20 and the associated air flow divider 84 thereon.

Another advantage of the present invention is that the liner of the combustor assembly 22 as defined by the liner rings 54, 66 and sleeve 72 produce a transpiration cooled wall construction that minimizes the requirement for wall cooling air while adequately cooling the inside surface of the combustor assembly exposed to the flame front within the combustion chamber 100.

The porous laminated material is made up of a plurality of porous plates *72a–72c* having a flow pattern therein of the type set forth in U.S. Pat. No. 3,584,972 issued June 15, 1971, to Bratkovich et al. The pores have a diameter such that the liner has a discharge coefficient of 0.006 per square inch of liner wall area. Air distribution into assembly 22 includes 11.5% of total air flow via assembly 98. A front row of primary holes 137 receives 14.5% of total air flow; a pair of rows of intermediate holes 139, 145 receive 8% and 5.6%, respectively, of the total combustor air flow. Dilution holes 147 in sleeve 72 receive 35.8% of the total combustor air flow.

The remainder of the total combustor air flow is through the liner wall pores. The aforesaid figures are representative of flow distributions in combustors using the invention. Cooling of the inner wall 142 of the sleeve 72 is in part due to transpiration cooling as produced by flow of compressed air from the duct 78 radially inwardly of the sleeve 76 through a plurality of pores therein fabricated in accordance with the structure of the aforesaid Bratkovich et al patent.

In the illustrated arrangement the liner includes a boss 144 at the ring 66 to serve as a mounting pad for a combustor igniter assembly 146. Likewise, the combustor assembly includes a side located crossover port 148 thereon as shown in FIG. 5 to connect adjacent combustor assemblies (not shown) in the duct 78.

In accordance with certain principles of the present invention the transition member 76 includes a pair of side walls 150, 152 and top and bottom walls 154, 156 that are hydromechanically formed porous laminated panels of the type set forth in the aforesaid Bratkovich et al patent. Each wall of member 76 has a porosity that produces a discharge coefficient of 0.006 per square inch of wall area. The side walls 150, 152 are joined by a top wall 154 and a bottom wall 156 of the transition member 76 at longitudinal seam welds 158, 160 at the edges of the side wall 150 and longitudinal seam welds 162, 164 at the side wall 152. The side walls 150, 152 and top and bottom walls 154, 156 are formed without substantial reduction to permeability due to forming thereby assuring good coolant flow therethrough.

Each of the longitudinal seam welds 158 through 164 is located at small corner radii as best shown in FIG. 4*a* wherein the ends 151, 155 of walls 150, 154 are shown enlarged to show small corner radii therein. The weld 158 is omitted in this view to show that the formation of ends 151, 155 tends to compress the laminated material at the ends 151, 155. The weld 158, shown in outline in FIG. 4*a* migrates into this region so that the longitudinal welds are located at regions where the porous laminated material is compressed to block pores. The weld locations also are at the cooler operating regions of the inner walls of the transition member 76. The aforesaid arrangement accordingly produces a minimal reduction of cooling of the inner walls of the transition member 76 as hot exhaust gases are directed therethrough to a downstream turbine nozzle assembly 166 thence for flow across a turbine wheel (not shown).

Another feature of the present invention is that a dilution dam 168 is located toward the aft end of the sleeve 72 to help provide uniform flow and minimize eddies through holes 147. The dam 168 includes a continuously formed inner peripheral wall 170 connected to the outer surface of the sleeve 72 by a plurality of spaced tack welds 172 that define an opening 174 between each of the tack welds 172 so that air will enter the porous laminated material of the sleeve 72 outside the support area and thereby diffuse under the support for the dam 168 and exit through the inside surface of the porous metal wall of the sleeve 72 to cool the inside surface thereof at a point directly radially inwardly of the dam 168.

The transition member 76 includes an outlet collar 176 thereon including a curved outer lip 178 that is slidably supported in a grooved support 179 that also serves as a support for an outer shroud of the nozzle assembly 166. An inwardly located curved lip 180 on collar 176 is slidably supported on a configured shelf 182 of a base support 184 that receives internal engine support struts 186 along with the inner ring of the nozzle assembly 166.

The lips 178, 180 thereby are free to both axially and radially accommodate expansion of the improved combustor 22 from the upstream supported end thereof.

While the embodiments of the present invention, as herein disclosed, constitute a preferred form, it is to be understood that other forms might be adopted.

We claim:

1. A canister type combustor assembly for supplying combustion products to the turbine nozzle of a gas turbine engine including a combustor support wall internally thereof comprising in combination: a tubular, multi-layered porous metal wall with pores and cavities therethrough and having an inlet end and an outlet end and an internal combustion chamber, a rigid outlet collar for connection to the turbine nozzle, said collar having side walls and curved inner and outer lips forming an arcuate passage located at a point offset to the longitudinal axis of said tubular porous metal wall, and a porous metal transition for joining said tubular porous metal wall to said outlet collar, said transition including side walls and top and bottom walls without substantial reduction in permeability due to forming, each of said transition walls including a sharp radius bend at the side edge thereof defining a metal section having pores and cavities therein compressed to increase the density of the transition walls at the sharp radius bends therein, and a seam weld joining adjacent ones of said sharp radius bends to seal the transition between the tubular porous metal wall and said outlet collar with minimal loss of permeability through the wall segments of said porous metal transition thereby to maximize flow of coolant flow through the transition for discharge through said outlet collar.

2. A canister type combustor assembly for supplying combustion products to the turbine nozzle of a gas turbine engine including a combustor support wall internally thereof comprising in combination: a tubular, multi-layered porous metal wall with pores and cavities therethrough and having an inlet end and an outlet end and an internal combustion chamber, a rigid outlet collar for connection to the turbine nozzle, said collar having side walls and curved inner and outer lips forming an arcuate passage located at a point offset to the longitudinal axis of said tubular porous metal wall, and a porous metal transition for joining said tubular porous metal wall to said outlet collar, said transition including side walls and top and bottom walls without substantial reduction in permeability due to forming, each of said transition walls including a sharp radius bend at the side edge thereof defining a metal section having pores therein compressed to increase the density of the transition walls at the sharp radius bends therein, and a seam weld joining adjacent ones of said sharp radius bends to seal the transition between the tubular porous metal and said outlet collar with minimal loss of permeability through the wall segments of said porous metal transition thereby to maximize flow of coolant flow through the transition for discharge through said outlet collar, said sharp radius bends extending axially of each transition wall at the coolest axially extending region of metal temperature in said transition between the tubular wall and said outlet collar.

3. A canister type combustor assembly for supplying combustion products to the turbine nozzle of a gas turbine engine including a combustor support wall internally thereof comprising in combination: a tubular, porous metal wall with pores and cavities therethrough and having an inlet end and an outlet end and an internal combustion chamber, a diffusion dam extending radially of said tubular wall and including an inner flange spaced from said wall, a plurality of tack welds securing said flange to said wall to define openings for flow of coolant air through said wall immediately inboard of said flange to cool the full extent of the inner surface of said wall, a rigid outlet collar for connection to the turbine nozzle, said collar having side walls and curved inner and outer lips forming an arcuate passage located at a point offset to the longitudinal axis of said tubular porous metal wall, and a porous metal transition for joining said tubular porous metal wall to said outlet collar plate, said transition including side walls and top and bottom walls without substantial reduction in permeability due to forming, each of said transition walls including a sharp radius bend at the side thereof defining a metal section having pores and cavities therein compressed to increase the density of the transition walls at the sharp radius bends therein and a seam weld joining adjacent ones of said sharp radius bends to seal the transition between the tubular porous metal wall and said outlet collar with minimal loss of permeability through the wall segments of said porous metal transition thereby to maximize flow of coolant flow through the transition for discharge through said outlet collar.

* * * * *